United States Patent [19]

Kinoshita

[11] Patent Number: 4,963,452

[45] Date of Patent: Oct. 16, 1990

[54] PHOTOSENSITIVE MEMBER FOR INPUTTING DIGITAL LIGHT

[76] Inventor: Koichi Kinoshita, 34-13, Nishi-Kusabuka-cho, Shizuoka-shi, Shizuoka-ken, Japan

[21] Appl. No.: 260,683

[22] Filed: Oct. 20, 1988

[30] Foreign Application Priority Data

Dec. 25, 1987 [JP] Japan ..... 62-32865

[51] Int. Cl.[5] ..... G03G 5/06; G03G 5/087

[52] U.S. Cl. ..... 430/78; 430/56; 430/84; 430/96

[58] Field of Search ..... 430/56, 78, 96, 84

[56] References Cited

U.S. PATENT DOCUMENTS

| | | | |
|---|---|---|---|
| 3,508,961 | 4/1970 | Makino et al. | 430/96 X |
| 3,816,118 | 6/1974 | Byrne | 430/56 |
| 3,981,728 | 9/1976 | Jones | 430/96 X |
| 4,335,195 | 6/1982 | Nishigaki et al. | 430/96 X |
| 4,356,246 | 10/1982 | Tabei et al. | 430/96 X |
| 4,684,572 | 8/1987 | Yasufuku et al. | 428/323 |

FOREIGN PATENT DOCUMENTS

| | | | |
|---|---|---|---|
| 61-170746 | 8/1986 | Japan | 430/56 |

*Primary Examiner*—Roland E. Martin

*Attorney, Agent, or Firm*—Marmorek, Guttman & Rubenstein

[57] ABSTRACT

A photosensitive member for inputting digital light comprises photoconductive fine crystals of a genuine semiconductor or an amorphous semiconductor and having a mean particle diameter of $0.01\mu$–$0.5\mu$ and a binder embedding the fine crystals and having a volume resistivity of higher than $10^{13}$ ohm-cm. A mixture of the fine crystals and the binder is formed into a photosensitive layer having a thickness of $5\mu$–$30\mu$ and $\gamma$ of a latent image of larger than 6. The photosensitive member can be used in various methods of electrophotography.

15 Claims, 5 Drawing Sheets

PHOTOSENSITIVE MEMBER FOR INPUTTING DIGITAL LIGHT

BACKGROUND OF THE INVENTION

This invention relates to a novel photosensitive member for inputting digital light which is utilized in the art of electrophotography, and more particularly a photosensitive member which can satisfy various requests regarding digital recording which are increasing with year. A prior art photosensitive member utilizing a specific flow pattern of photo-current in a thin photosensitive layer, formed by binding fine photoconductive crystals of a small particle diameter with a highly insulative binder, has not been utilized commercially for inputting digital light.

Photosensitive members utilized in the prior art method of electro-photography were simple photoconductors or photoconductors resembling them. In U.S. Pat. No. 2,297,691 to Carlson, photosensitive members made of sulfur, anthracene, anthraquinone, melted mixture of sulfur and selenium or anthracene, etc. are disclosed. In recent years, photosensitive members including a photosensitive layer made up of amorphous Se, or amorphous silicon or a bonded layer of ZnO prepared to have characteristics similar to that of the amorphous Se layer has been used. More particularly, a photosensitive layer of the so-called function separation type utilizing organic semiconductors has been developed in recent years.

The inventor has invented a series of the methods of electrophotography utilizing a photosensitive member comprising a combination of a highly insulative film and a photosensitive layer. All of the prior art methods of electrophotography were developed based on analogue theory, and efforts have been made to cause so-called $\gamma$ characteristic to approach that of the film used in the silver chloride photographic technique. As a consequence, materials which were selected such that photocurrent proportional to the quantity of incident light would flow have been used as a rule. For this reason, photosensitive members utilizing above mentioned amorphous Se layer or the like have been used.

Consequently, the photosensitive member based on the analogue concept and utilized in the prior art methods of electrophotography is not suitable for use in electrophotography which operates digitally in view of the $\gamma$ characteristic of the latent image. In the digitally operating devices are included computer output devices, copy machines in which a picture image is processed after digital decomposition, and any other digital machines. Accordingly, in the art of electrophotography, provision of a photosensitive member capable of utilizing digitally operating electrophotography has strongly been desired.

SUMMARY OF THE INVENTION

Accordingly, it is an object of this invention to provide a photosensitive member including a photosensitive layer having a steep variation in the value of $\gamma$ of a latent image so that the photosensitive member is suitable for digitally processing a picture image.

The value of $\gamma$ concerns the degree of blackness of a visible image obtained by developing a silver halide film, but for convenience "$\gamma$ of a latent image" is set on the assumption that the intensity of the latent image produced by electrophotography and the developed or visualized image corresponds to each other at a ratio of 1:1.

According to this invention there is provided a photosensitive member for inputting digital light comprising photoconductive fine crystals of a semiconductor having a mean particle diameter of $0.01\mu$–$0.5\mu$ and a binder having a volume specific resistivity of higher than $10^{13}$ ohm-cm, the photoconductive fine crystals being dispersed in the binder, and a resulting mixture of the fine crystals and the binder being formed as a thin film having a thickness of $5\mu$–$30\mu$ and steeply varying $\gamma$ of a latent image formed on the thin film.

DESCRIPTION OF THE PREFERRED EMBODIMENTS

Figure 1:
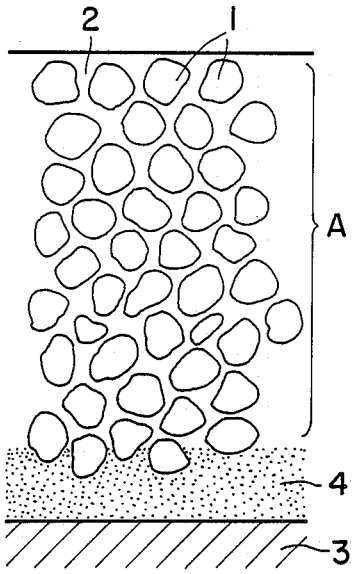
FIG. 1 is a partial enlarged sectional view showing the construction of the photosensitive member embodying the invention.

The photosensitive layer of this invention has a construction as shown in FIG. 1. As shown, numerous photoconductive fine crystals are dispersed in a highly insulative binder 2 such that crystals are perfectly isolated from each other. Between a photosensitive layer A constituted by the crystals 1 and the binder 2 and an electrode 3 may be interposed a layer 4 of low resistance material for the purpose of intimately interconnecting the photosensitive layer A and the electrode 3.

Figure 5:
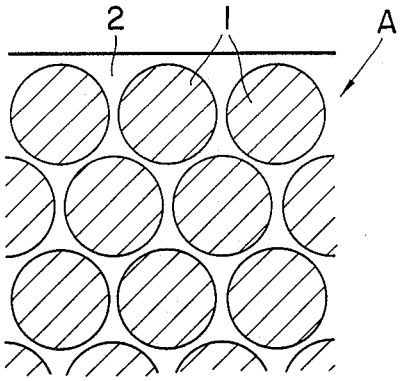
FIG. 5 is an enlarged diagrammatic sectional view showing the construction of a portion of the photosensitive layer near the photosensitive member.
Figure 6A:
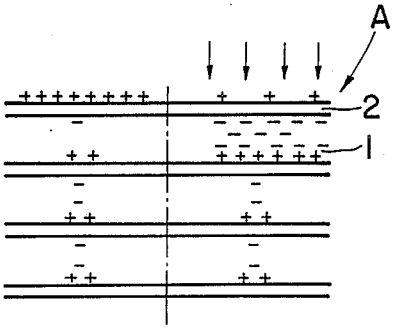
FIGS. 6(*a*) and 6(*b*) are diagrammatic representations showing the state of charging.
Figure 6B:
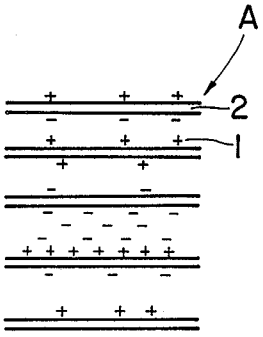
Figure 2:
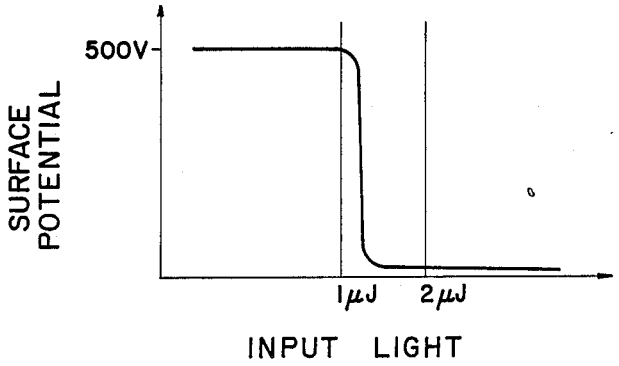
FIG. 2 is a graph showing the $\gamma$ curve of a latent image formed on the photosensitive member shown in FIG. 1.
Figure 3:
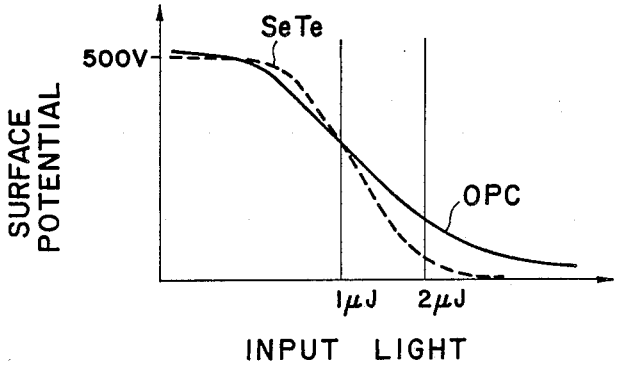
FIG. 3 is a graph showing the $\gamma$ curves of latent images formed on various photosensitive members considered to have the same photosensitivity.
Figure 4:
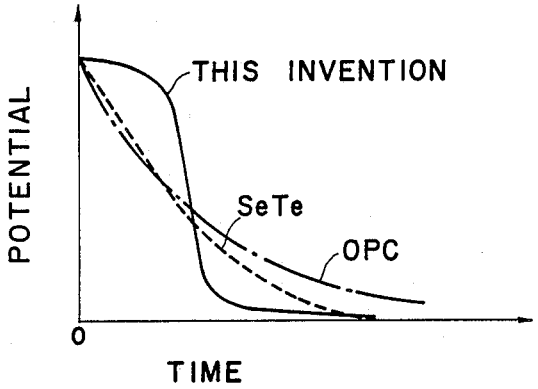
FIG. 4 is a graph showing the response characteristic of the photosensitive member shown in FIG. 1.

The outstanding feature of the photosensitive member of this invention lies in the $\gamma$ curve of a latent image formed thereon. For reference, $\gamma$ curves of latent images of various photosensitive members considered to have the same photosensitivity are shown in FIG. 3. The characteristic suitable for visualizing the digital input light is clearly shown in FIG. 2. For explaining the mechanism contributing to this characteristic, a response to a small input light is shown in FIG. 4 in which the abscissa shows time while the ordinate the surface potential. This graph too shows a specific performance of the photosensitive member of this invention. This graph shows that the photosensitive member does not immediately respond to the incident light but responds rapidly when the incident light is accumulated to a certain extent and then decreases to a so-called residual level. Of course the clarification of the operating mechanism is not the object of this invention, but the explanation of the operating mechanism is useful to explain the substance of this invention. The photosensitive member manifesting the characteristics shown in FIGS. 2 and 4 has a specific performance which can be explained by using a model as follows. FIG. 5 is an enlarged diagrammatic view of a portion near the surface of the photosensitive layer. FIG. 6*a* is a more diagrammatic representation showing a charged state and a state in which light is impinged upon a portion of the surface. FIG. 6*b* shows the steps of the surface potential attenuation in which a group of charge carriers moves at a portion irradiated by light. When a surface potential of 500 V is applied to the surface of the photosensitive member of embodiment 1 to be described later, an extremely high electric field of 33 V per micron would be applied. The mean particle diameter of fine crystals of $\alpha$type copper phthalocyanine is about $0.02\mu$. Each primary coagulation in the binder is considered to include several tens of the fine crystals. Assume now that a coagulation has a diameter of about $0.1\mu$. Since each coagulation contains more than several tens of the fine crystals, it can be considered that each coagulation has a shape close to a sphere. Based on these assumptions, the thickness of the binder layer at its thin portion is about $4\times10^{-6}$ cm, which is very thin. In this case, a photosensitive layer having a thickness of $18\mu$ contains about 230 coagulations which are superposed in the direction of thickness. Then the voltage across the thin binder layer is about 1.9 V meaning that electric field somewhat less than the electric field at which tunnel current begins to flow is applied. On the other hand, electric field of $2.9\times10^5$ v/cm is applied to phthalocyanine, which is very strong electric field. The specific performance of the charge carriers when a strong electric field is applied to crystals is described in various printed matters but as the performance is caused by a combination of several phenomena, it cannot be determined simply. Anyhow the specific performance is determined by a high speed motion of the charge carriers accelerated by the strong electric field concerning the level of phonons. When a charge carrier is accelerated to a high speed it collides against photons to form charge carriers but such charge carriers disappear immediately. However, when the charge carrier is accelerated to an extremely high speed it merely passes through the photon without colliding against it and would be accelerated to much more high speed. Finally, the charge carrier accelerated to the much more high speed collides against the photon to form new charge carriers. This phenomenon is called avalanche. The intensity of the above mentioned electric field is sufficient to cause the avalanche phenomenon. Since extremely strong electric field is applied across the interfaces between the highly insulative binder and the fine crystals, the charge carriers can readily pass through the interfaces. Once the avalanche occurs, the charge carriers move as a group toward the electrode, so that the intensity of the electric field increases with time in the lower portion of the photosensitive layer with the result that the groups of charge carriers reach the electrode without stopping.

Since the wavelength of light incident upon the surface of the photosensitive member is in a wavelength band in which the light is strongly absorbed, the depth in which light excitation occurs is only several tens of microns. However, due to the mechanism described above steep variation in the value of $\gamma$ of the latent image is formed as shown in FIG. 2.

Figure 12:
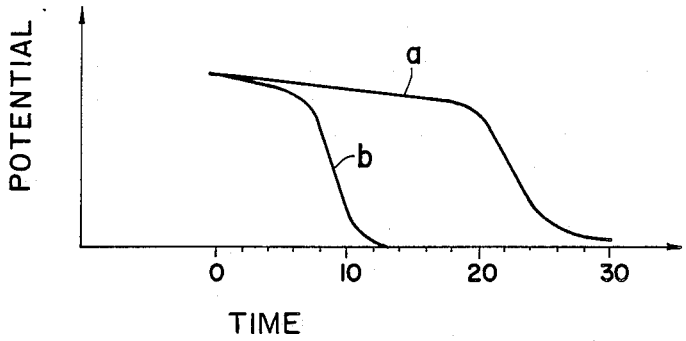
FIG. 12 is a graph showing the dark attenuation characteristic of the surface of the photosensitive member described above.

A specific phenomenon of the photosensitive member of this invention contributes to the generation of avalanche. More particularly, FIG. 12 shows the dark attenuation of the surface potential of the photosensitive member of the embodiment 1 to be described later. In FIG. 12 the abscissa represents time, while the ordinate the surface potential. In FIG. 12 curve a shows the dark attenuation when the photosensitive member is started to operate after a long pause, whereas curve b shows the dark attenuation immediately after repetition of charge and discharge in 30 minutes and at a rate of once per 3 seconds. As shown, even in the absence of the input light the potential attenuates rapidly from a certain point. It is understood that this is caused by the fact that thermally excited charge carriers are accumulated to cause the avalanche phenomenon, and that this phenomenon is caused by the increase in the temperature of the lattice of the crystal. Accordingly, when charge and discharge are rapidly repeated the attenuation begins at an earlier point as shown by curve b. For a continuous operation, the time at which the attenuation begins is determined by a balanced state. So long as the dark potential holding time is sufficiently long in the balanced state, the photosensitive member of this invention can be used commercially.

The prior art photosensitive member was constructed to realize high analogue fidelity so that its material should have a uniform structure. All of presently used photosensitive members including amorphous type photosensitive member, function isolation type organic photoconductor (OPC), and photosensitive members wherein particules of CdS or ZnO are contained in a binder are included in the type just described.

In contrast, the invention is based on not homogeneous material.

In the combination of Uban 20-HS (melamine resin manufactured by Mitsui Toatsu Co.) and P-645 (a polyester resin manufactured by Mitsui Toatsu Co.) utilized as the binder in embodiment 1 to be described later, Uban 20-HS and P-645 are bridged each other to form a perfect insulator.

Measured volume specific resistivity of the insulator was $10^{15}$ ohm-cm. In addition to such high resistivity, the combination has a very strong bonding force at the interface between the insulator and the phthalocyanine crystals. This is caused by the fact that since the two binders have terminal radicals having opposite electric characteristics causing bridging, either one of the two type binder molecules adsorbs the other whether plus points or minus points are present on the surface of copper phthalocyanine so that the interface between the phthalocyanine crystal and the binder is dense and strong. Under this state, the operation described above becomes more reliable.

Even in a digital input light, there is an optical halo. For example, where a LED is used a cellphoc optical system (an array of cylindrical lenses) is used, whereas where laser light is used a Fθ lens and other optical system are used. The relative movement between the photosensitive member and the light source, the distortion of the light quantity about a brilliant point and useless optical halo caused by other reasons should be avoided.

In the prior art method of electrophotograph, unwanted halo was eliminated by varying the voltage impressed at the time of development. With such measure the energy of the latent image is decreased so that it has been impossible to reproduce the detail of the picture image, thus substantially impairing the picture quality.

According to this invention, the halo is removed at the time of forming a latent image on the photosensitive member. This measure is not only extremely theoretical but also a latent image having a high SN ratio is formed. As a consequence, detail of the picture image can be reproduced after development.

As above described, the invention is based on the dispersion of photoconductive fine crystals in a highly insulative binder such that the crystals are isolated by the binder so that there is a limit on the material used. Notwithstanding the fact that whether the photoconductive crystals are of the N type or P type, in order to fully manifest the feature of this invention, it is desirable that the mean particle diameter of the fine crystals should be less than 0.5μ. Because as the number of interfaces distributed in the thickness direction of the photosensitive layer increases, the γ characteristic of the latent image inherent to this invention in which the avalanche is started and varies substantially vertically becomes predominant. Of course, a small diameter of the crystal particles contributes to a high resolution.

The binder should have a high insulating strength. Preferably, its specific resistance should be higher than $10^{13}$ Ohm-cm. Where the binder has a high mechanical strength, the durability of the photosensitive member can be improved especially in the Carlson patent described above. High dispersion property is an important factor for stably generating avalanche. Due to the terminal radicals, the binders utilized in the embodiments to be described later, assure satisfactory dispersion. But it should be understood that the invention is not limited to the embodiments.

The surface flattening and smoothing operation with rollers during the drying step used in embodiment 1 to be described later is described in my Japanese Patent Application No. 36420 of 1987. With this method, it is possible to obtain a photosensitive layer having a flat and smooth surface, that is a surface coarseness of less than 0.1 S.

EMBODIMENT 1

| | |
|---|---|
| α type copper phthalocyanine | 10.6 g |
| P-645 (polyester resin) in terms of a solid component | 25.2 g |
| Uban 20-HS (melamine resin) in terms of a solid component | 6.44 g |
| cyclohexanone | 210 g |

Figures 13A, 13B, 13C, 13D:
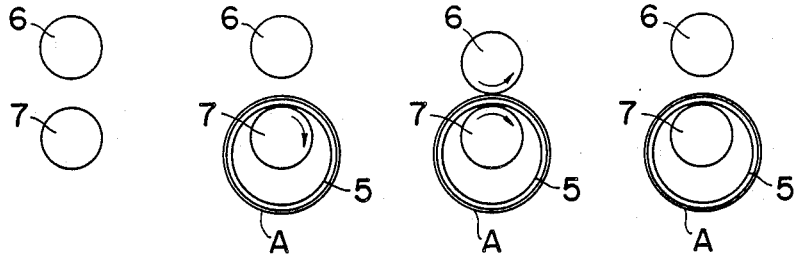
FIGS. 13*a*–13*d* are cross-sectional views showing the steps of flattening the photosensitive layer of the photosensitive member according to this invention.

A mixture of these components was admixed in a ball mill for 24 hours to obtain a coating liquid. An aluminum cylinder was prepared and its surface was worked to have a surface flatness of about 0.1S. Thereafter, casein was coated and dried to obtain a casein film having a thickness of 1μ. After coating the coating liquid onto the casein film, the assembly was air dried for 60 minutes at a temperature of 50° C. The aluminum cylinder 5 was mounted on a press roller 7 when the press roller 7 is separated away from a mirror surface roller 6. (see FIG. 13*a* and FIG. 13*b*). Then the press roller 7 is rotated to rotate the cylinder 5 therewith. Then the mirror surface roller 6 is urged by a spring, not shown, against the photosensitive layer A formed on the surface of cylinder 5 by the coating liquid. Since the mirror surface roller 6 is made of hard material, for example metal, and since the press roller 7 is made of soft rubber, the photosensitive layer A would be pressed uniformly along a contact line between rollers 6 and 7. This state was maintained for a suitable time while rotating the roller 7 as shown in FIG. 13*a* and then the press roller 6 was separated away as shown in FIG. 13*d*, and the press roller 7 was stopped to finish the flattening operation. Thereafter, cylinder 5 was removed from the roller 7 and then heated for 60 minutes in an atmosphere maintained at 150° C. to obtain a photosensitive layer having a thickness of 12μ.

The flatness of the surface of the photosensitive layer A mechanically flattened with the device shown in FIG. 13 and then heat hardened was less than 0.1 S. By this flattening operation, the mechanical strength of the surface of the photosensitive layer is increased. When the surface of the photosensitive layer A is rough, not only the edge of a cleaning blade used to wipe away toner remaining on the surface of the photosensitive layer, but also the photosensitive layer would be damaged by the cleaning blade, thus shortening the life of the photosensitive layer. Especially, where paper dust is generated in a recorder, the effect of mechanical flattening is large. Moreover, the flattening not only improves resolution but also prevents partial generation of avalanche phenomenon.

The photosensitive member was used in the method of electrophotography disclosed in the Carlson's U.S.A. patent. A corona discharge device was used to charge in the dark the photosensitive member to a surface potential of +500 V. A picture image signal was applied such that light having a wavelength of 780 mμ and having an energy of 2 μJ/cm² was projected to bright portions of the picture image. At portions irradiated by light, the surface potential was decreased to about +20 V, whereas at portions not irradiated by light the surface potential of 500 V was maintained. The latent image was developed using a conventional toner. Even when the quantity of the incident light was changed to 3 μJ/cm², no change was observed in the result. The same result was obtained even when the quantity of the incident light was reduced to 1.5 μJ/cm². However, when the light input was reduced to 1 μJ/cm², signal response became substantially zero and the intensity of the developed image was decreased greatly to an extent that image can be noted slightly. FIG. 2 shows the sensitivity curve of this photosensitive member under the condition described above.

Under this condition, the characteristic of the photosensitive member was repeatedly measured over 500,000 revolutions, but no variation of the characteristic was noted. The reproduced picture images obtained were extremely clear and dots and lines were sharply defined.

A control example utilizing N type photoconductor crystals will now be described.

CONTROL EXAMPLE 1

Photoconductive crystals of CdS having a mean diameter of 3μ and utilizing C1 as a coactivator were prepared. These CdS crystals contain copper of $10^4$ moles and are widely used in conventional electrophotography.

| | |
|---|---|
| CdS | 15 g |
| P-645 | 8.3 g |
| Uban 20-HS | 2.1 g |
| cyclohexanone | 10 g |

These compositions were admixed in a ball mill to obtain a coating liquid.

This coating liquid was coated in the same manner as in embodiment 1 and then dried to a thickness of 15μ to obtain a photosensitive layer or member. The characteristic of this photosensitive member is shown in FIG. 7.

Figure 7:
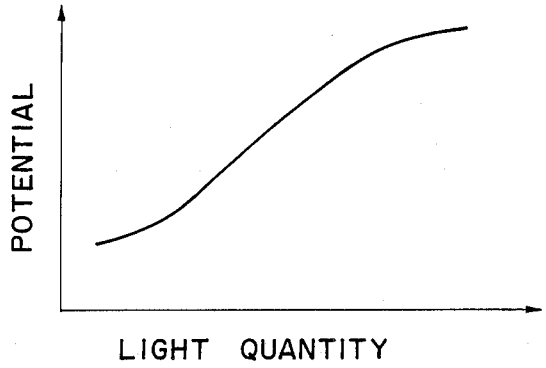
FIG. 7 is a graph showing the photosensitive characteristic of the photosensitive member of control example 1.

Comparison of this characteristic with that of embodiment 1 shows that a steep variation in γ of the latent image disappears meaning that the characteristic shown in FIG. 7 is a conventional one.

The embodiment 1 and the control example 1 teach that steep variation in the γ characteristic of the latent image can be obtained only when the internal structure of the photoconductive crystals is simple and the unnecessary carrier collision in the crystals does not occur. In other words, the photosensitive material belongs to the so-called genuine semiconductor, thus ensuring generation of the avalanche phenomenon.

Embodiment 2 shows a modified embodiment utilizing a different binder.

EMBODIMENT 2

Instead of the binder utilized in embodiment 1, a polyurethane resin was used.

| | |
|---|---|
| α type copper phthalocyanine | 10.6 g |
| polyurethane | 31.6 g |
| cyclohexanone | 210 g |

These compositions were admixed in a ball mill to obtain a coating liquid. This coating liquid was applied, flattened with rollers, and heat hardened for 24 hours in an atmosphere maintained at 60° C. to obtain a photosensitive member having a thickness of 12μ in the same manner as in embodiment 1.

Figure 8:
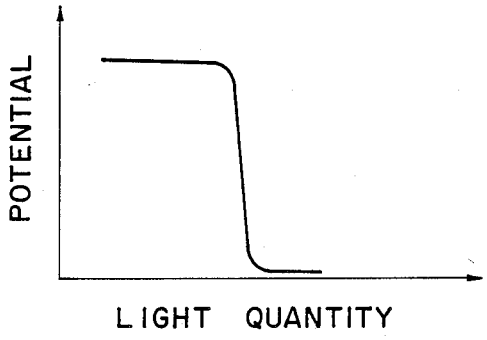
FIG. 8 is a graph showing the photosensitive characteristic of the photosensitive member of embodiment 2.

The characteristic of this photosensitive member is shown in FIG. 8 which shows a steep variation in the γ characteristic of the latent image.

EMBODIMENT 3

| | |
|---|---|
| fine particles of Se having a mean particle diameter of 0.3 μ and a purity of more than 99.99% | 30 g |
| S5B | 20 g |
| toluene | 30 g |
| cyclohexanone | 30 g |

Figure 9:
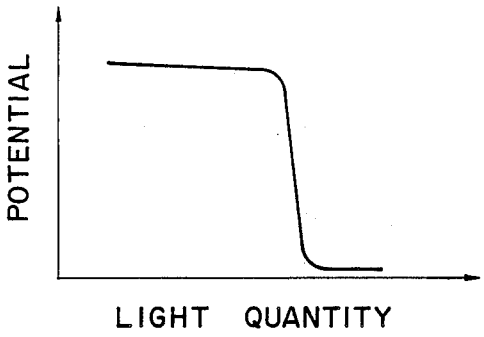
FIG. 9 is a graph showing the photosensitive characteristic of the photosensitive member of embodiment 3.

These compounds were admixed in a ball mill for 6 hours to obtain a coating liquid. This coating liquid was applied and air dried. Then the coated surface was flattened and dried for 12 hours in an atmosphere maintained at 25° C. to obtain a photosensitive member having thickness of 30μ in the same manner as in embodiment 1. This photosensitive member too showed a steep γ characteristic of the latent image as shown in FIG. 9.

To clarify the function of the binder, a low resistivity binder was used in the following control example 2.

CONTROL EXAMPLE 2

| | |
|---|---|
| α type copper phthalocyanine | 10.6 g |
| BL-1 | 31.6 g |
| ethanol | 50 g |
| isobuthyl acetate | 50 g |

Figure 10:
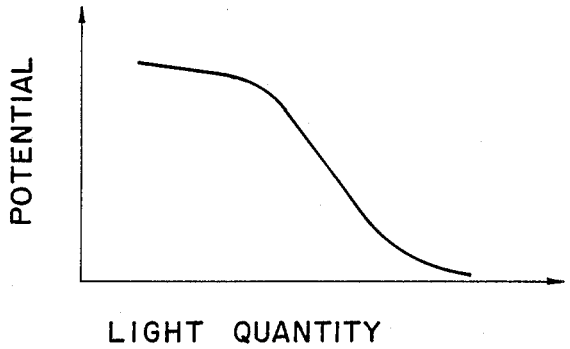
FIG. 10 is a graph showing the photosensitive characteristic of the photosensitive member of control example 2.

These components were admixed for 6 hours in a ball mill and a photosensitive member was obtained in the same manner as in embodiment 3. The characteristic of this photosensitive member is shown in FIG. 10.

The volume specific resistance of this binder was $10^{11}$ ohm-cm.

Control example 2 shows that use of a special binder is essential to create steep variation in γ of the latent image.

The ranges of the materials utilized in the foregoing embodiments can be changed in a certain extent. Theoretically, it is desirable that the photosensitive fine crystals are intrinsic semiconductors having pure structure. Both α type copper phthalocyanine and Se are considered to be in amorphous states which are typical states easy to create the performance of the intrinsic semiconductor photoconductors. Where the life of free charge carriers in the photoconductor is elongated by incorporating impurities, such photoconductor is not suitable for the present invention. Inorganic materials such as BaO, ZnS, AgI, ZnSe, CdS, PbO, HgS, CdSe, CdTe, GaAs and others cannot be used. In an organic photosensitive member, where such pigments as phthalocyanine, phthalocyanine green, rhodamine and crystal violet, and fine crystals of anthracene, anthraquinone, naphthalene, etc. are used, the desired γ characteristic of the latent image can be obtained. As the binder can be used various compounds such as polyester, acryl, epoxy, urethane, carbonate, cellulose, polystyrene, vinyl, etc. Compounds, generally defined as electric insulators, are suitable as the binder. For this reason, materials having a volume specific resistivity higher than $10^{13}$ ohm-cm are used. Presence of impurities or free radicals should be avoided because they prevent tunnel effect, and flow of charge current due to Schottkey effect.

The particle diameter of the photosensitive crystals should also be taken into consideration. Since in this invention it is necessary that the photosensitive fine crystals are uniformly embedded or covered by the insulator, if the crystals were too large, desired number of interfaces could not be formed in the direction of thickness of the photosensitive layer thus failing to obtain steep γ of the latent image. Preferred mean diameter of the crystals is less than 0.5μ. If the mean diameter becomes less than 0.01μ charge carriers would not be accelerated sufficiently in the crystals so that the speed is low, thereby failing to accomplish the object of this invention.

Figure 11:
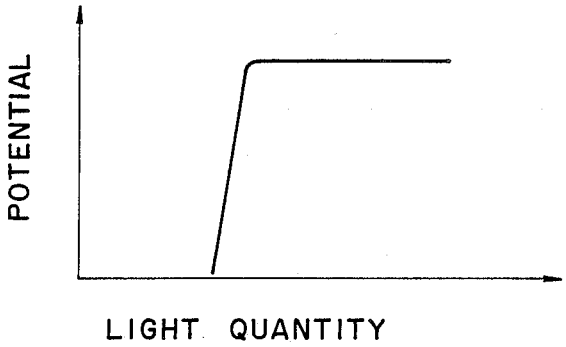
FIG. 11 is a graph showing the $\gamma$ characteristic of an image of the photosensitive member embodying the invention.

FIG. 11 shows the photosensitive characteristic of the photosensitive member of this invention in terms of the γ characteristic of the image. Since the digital characteristics of the method of development and developing agent have an influence, γ of the developed image becomes larger than 50. To ensure avalanche phenomenon the value of γ of the latent image must be large. In practice, it is desirable that γ is larger than 6. When the thickness of the photosensitive layer is in a range of 5μ–30μ, satisfactory result can be obtained in view of the relation between charge acceptance and the intensity of electric field. Although the photosensitive elements shown in the embodiments have a two layer construction, that is a photosensitive layer and a back electrode, it should be understood that the invention is not limited to this construction, and the same advantageous effect can be obtained with a three layer construction that is a construction wherein a highly insulative layer is bonded to the surface of the photosensitive layer.

As above described, according to this invention there is provided a novel photosensitive member having γ of a latent image of larger than 6 by using fine crystals of intrinsic semiconductor or fine crystals of organic or inorganic photoconductor similar thereto, and a binder having resistivity of larger than $10^{13}$ ohm-cm. By the steep variation of γ of the latent image, the response to digital light signal becomes stable and high. Taking a LED array as an example, presently used LED array is required to emit light, the quantity thereof varying within a limit of ±15% so that where a high quality of reproduced picture image is desired, a severe requirement of a limit of ±5% is imposed upon the LED array.

In contrast, in the photoconductor member of this invention, so long as the emitted light quantity is sufficient, the permissible range of the variation in the light quantity emitted by respective LEDs in the array is greatly widened, thus greatly decreasing the manufacturing cost of the LED array. Moreover, as the halo of the reproduced light image is eliminated at the time of forming a latent image, its resolution is high, so that it is possible to obtain high quality reproduced picture image that cannot be obtained with a prior art photosensitive member. Elimination of the halo of the light image greatly decreases noise so that the quality of the latent image can be improved.

As a consequence of these facts the resolution of the latent image can be increased to more than 50 lines/mm. In other words, a reproduced picture image has the same or harder tone as that of a silver chloride lith film.

I claim:

1. A digital photosensitive member for use in electrophotography by utilizing avalanche phenomenon, comprising:

photoconductive fine crystals of an intrinsic semiconductor or an amorphous semiconductor, said fine crystals having a mean particle diameter of about 0.01μ–0.5μ; and a binder having a volume specific resistivity higher than $10^{13}$ ohm-cm, said photoconductive fine crystals being dispersed in said binder so that substantially all of said fine crystals are electrically insulated from their neighbors by said binder; and a resultant mixture of said fine crystals and binder being formed as a thin film having a thickness of about 5μ–30μ, and a γ of a latent image formed in said film having a value larger than 6.

2. The photosensitive member according to claim 1 wherein said semiconductor comprises a intrinsic semiconductor.

3. The photosensitive member according to claim 1 wherein said semiconductor comprises an amorphous semiconductor.

4. The photosensitive member according to claim 1 wherein said photoconductive fine crystals are made of α type copper phthalocyanine.

5. The photosensitive member according to claim 1 wherein said photoconductive fine crystals are made of selenium.

6. The photosensitive member according to claim 1 wherein said binder comprises a mixture of polyester and melamine.

7. The photosensitive member according to claim 1 wherein said intrinsic semiconductor is substantially pure.

8. The photosensitive member according to claim 1 wherein said binder has a volume specific resistivity of about $10^{15}$ ohm-cm.

9. A digital photosensitive member for use in electrophotography by utilizing avalanche phenomenon, comprising photoconductive fine crystals of an intrinsic or an amorphous semiconductor material selected from the group consisting of an organic semiconductor and selenium, said fine crystals having a mean particle diameter of about 0.01μ–0.5μ; and a binder having a volume specific resistivity higher than $10^{13}$ ohm-cm;

said photoconductive fine crystals being dispersed in said binder so that substantially all of said fine crystals are electrically insulated from their neighbors by said binder; and a resultant mixture of said fine crystals and said binder being formed as a thin film having a thickness of about 5μ–30μ, and a γ of a latent image formed in said film having a value larger than 6.

10. The photosensitive member of claim 9 wherein said semiconductor material comprises an amorphous semiconductor.

11. The photosensitive member of claim 9 wherein said binder comprises a mixture of polyester and melamine.

12. The photosensitive member of claim 9 wherein said binder has a volume specific resistivity of about $10^{15}$ ohm-cm.

13. A digital photosensitive member for use in electrophotography by utilizing avalanche phenomenon, comprising photoconductive fine crystals of phthalocyanine or selenium, said fine crystals having a mean particle diameter of about 0.01μ–0.5μ; and a binder having a volume specific resistivity higher than $10^{13}$ ohm-cm;

said photoconductive fine crystals being dispersed in said binder so that substantially all of said fine crystals are electrically insulated from their neighbors by said binder; and a resultant mixture of said fine crystals and said binder being formed as a thin film having a thickness of about 5μ–30μ; and a γ of a latent image formed in said film having a value larger than 6.

14. The photosensitive member of claim 13 wherein said binder comprises a mixture of polyester and melamine.

15. The photosensitive member of claim 13 wherein said binder has a volume specific resistivity of about $10^{15}$ ohm-cm.

* * * * *